US010711222B2

(12) United States Patent
Toda

(10) Patent No.: US 10,711,222 B2
(45) Date of Patent: Jul. 14, 2020

(54) CLEANING LIQUID

(71) Applicant: DAIDO METAL CO., LTD., Nagoya-shi, Aichi (JP)

(72) Inventor: Kazuaki Toda, Inuyama (JP)

(73) Assignee: Daido metal Co., Ltd., Aichi (JP)

( * ) Notice: Subject to any disclaimer, the term of this patent is extended or adjusted under 35 U.S.C. 154(b) by 0 days.

(21) Appl. No.: 16/303,800

(22) PCT Filed: May 22, 2017

(86) PCT No.: PCT/JP2017/019072
§ 371 (c)(1),
(2) Date: Nov. 21, 2018

(87) PCT Pub. No.: WO2017/204169
PCT Pub. Date: Nov. 30, 2017

(65) Prior Publication Data

US 2020/0063064 A1 Feb. 27, 2020

(30) Foreign Application Priority Data

May 24, 2016 (JP) ..... 2016-103624

(51) Int. Cl.
*B08B 3/00* (2006.01)
*C11D 3/00* (2006.01)
*C11D 17/02* (2006.01)

(52) U.S. Cl.
CPC ..... *C11D 3/0052* (2013.01); *C11D 17/02* (2013.01)

(58) Field of Classification Search
CPC .. B08B 3/10; B08B 3/102; B08B 3/12; B08B 3/04; B08B 7/026; B08B 2203/007; B08B 7/0021
See application file for complete search history.

(56) References Cited

U.S. PATENT DOCUMENTS

2009/0029041 A1* 1/2009 Natsume ..... C11D 11/0047 427/129
2012/0240956 A1 9/2012 Nishimoto et al.
2018/0161737 A1* 6/2018 Tachibana ..... B01F 5/02
(Continued)

FOREIGN PATENT DOCUMENTS

JP 2011-025200 A 2/2011
JP 2011-088979 A 5/2011
JP 2011-173086 A 9/2011
(Continued)

OTHER PUBLICATIONS

Ruttley, T., https://blogs.nasa.gov/ISS_Science_Blog/2011/04/15/post_1301433765536/ (Year: 2011).*
(Continued)

*Primary Examiner* — John R Hardee
(74) *Attorney, Agent, or Firm* — Carrier Blackman & Associates, P.C.; Joseph P. Carrier; Anne G. Sabourin

(57) ABSTRACT

A cleaning liquid includes a liquid (53), a first fine gas bubble group (59*a*) included in the liquid (53) and having a gas at a first temperature, and a second fine gas bubble group (59*b*) included in the liquid (53) and having a gas at a second temperature that is lower than the first temperature. Therefore, it is possible to provide a cleaning liquid that exhibits a remarkably better cleaning effect than ever before.

2 Claims, 13 Drawing Sheets

(56) References Cited

U.S. PATENT DOCUMENTS

2019/0186767 A1* 6/2019 Patel ..... F24F 11/30

FOREIGN PATENT DOCUMENTS

| | | | |
|---|---|---|---|
| JP | 2012-004331 | A | 1/2012 |
| JP | 2012-157789 | A | 8/2012 |
| JP | 2013-034993 | A | 2/2013 |
| JP | 2014-226251 | A | 12/2014 |
| JP | 2015-080756 | A | 4/2015 |
| JP | 2015-098014 | A | 5/2015 |
| WO | 2011/067955 | A1 | 6/2011 |

OTHER PUBLICATIONS

Official Communication dated Jan. 30, 2019, issued in the corresponding Japanese Patent Application No. 2016-103624.

* cited by examiner

CLEANING LIQUID

TECHNICAL FIELD

The present invention relates to a cleaning liquid including a fine gas bubble group in a liquid.

BACKGROUND ART

Patent Document 1 discloses a cleaning liquid. The cleaning liquid includes nano-size gas bubbles dissolved in a liquid at a saturation dissolution concentration. Patent Document 1 focuses on the hydrogen bonding distance of the liquid molecules in order to improve the cleaning effect.

RELATED ART DOCUMENTS

Patent Documents

Patent Document 1: Japanese Patent Application Laid-open No. 2011-88979

SUMMARY OF THE INVENTION

Problems to be Solved by the Invention

Patent Document 1 in addition focuses on external forces that collapse gas bubbles. Such external forces include pressure change, temperature change, shock waves, ultrasonic waves, infrared radiation and vibration. It is surmised that the collapse of gas bubbles contributes to an improvement in the cleaning power.

An object of the present invention is to provide a cleaning liquid that exhibits a remarkably better cleaning effect than ever before.

Means for Solving the Problems

According to a first aspect of the present invention, there is provided a cleaning liquid comprising a liquid, a first fine gas bubble group included in the liquid and comprising a gas at a first temperature, and a second fine gas bubble group included in the liquid and comprising a gas at a second temperature that is lower than the first temperature.

Effects of the Invention

In accordance with the first aspect, when an object makes contact with the cleaning liquid, the first fine gas bubble group and the second fine gas bubble group act one after another on the border (interface contour) between the surface of the object and a substance (e.g. contaminant) adhering to the surface of the object. Due to the gas at a first temperature and the gas at a second temperature acting on the same position, the temperature repeatedly changes at the interface contour (the temperature oscillates). The oscillation of the temperature causes detachment at the interface. Accompanying the progress of detachment the gas penetrates into the inside via the contour. In this way, the substance becomes detached from the surface of the object. The substance is separated from the object. By virtue of the action of the temperature oscillation, the cleaning liquid exhibits a remarkably better cleaning effect than ever before even without necessarily using the energy of collapsing gas bubbles.

EXPLANATION OF REFERENCE NUMERALS AND SYMBOLS

Figure 1:
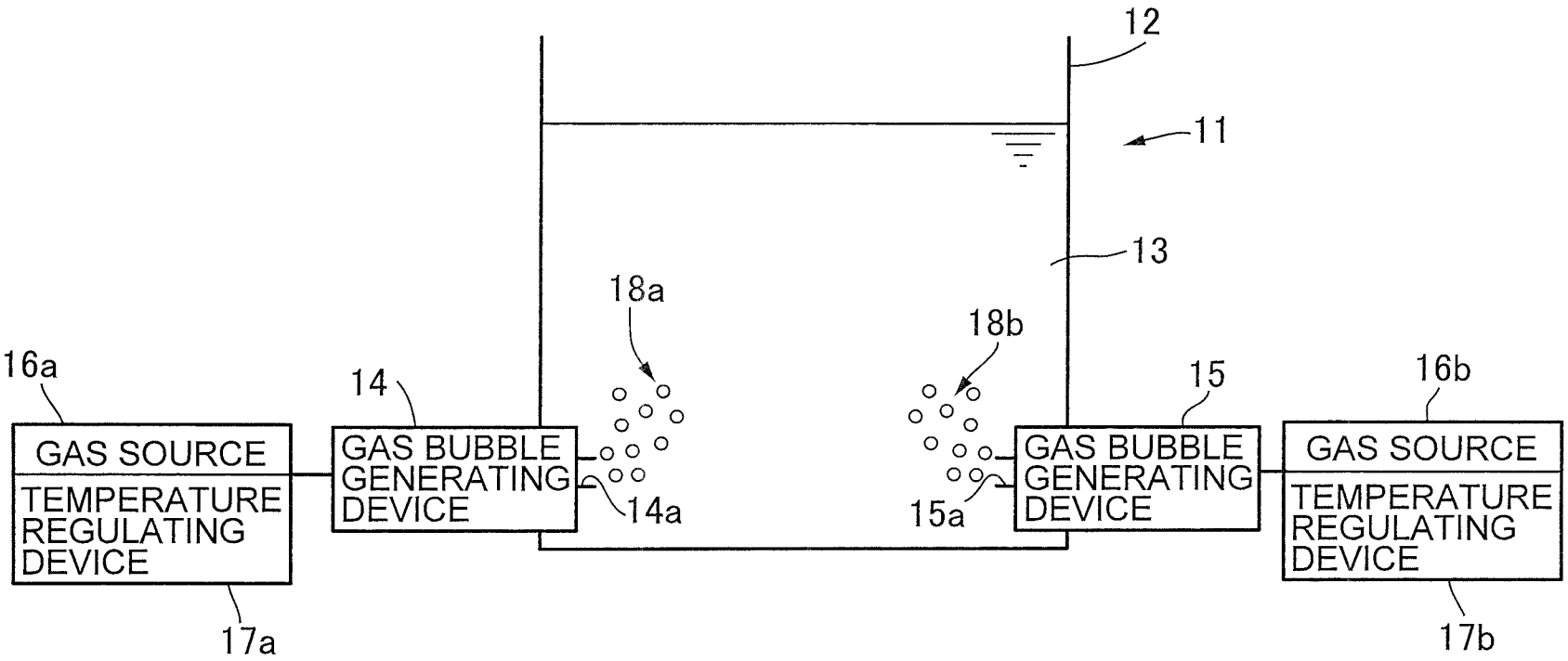
FIG. 1 is a schematic diagram showing an overall picture of a cleaning liquid production device related to a first embodiment of the present invention.

13 Liquid
18*a* First fine gas bubble group
18*b* Second fine gas bubble group
24 First fine gas bubble group
27 Second fine gas bubble group
35*a* First fine gas bubble group
35*b* Second fine gas bubble group
44*a* First fine gas bubble group
44*b* Second fine gas bubble group
53 Liquid
59*a* First fine gas bubble group
59*b* Second fine gas bubble group
64 First fine gas bubble group
67 Second fine gas bubble group

MODES FOR CARRYING OUT THE INVENTION

Embodiments of the present invention are explained below by reference to the attached drawings.

(1) Cleaning Liquid Production Device Related to First Embodiment

FIG. 1 shows an overall picture of a cleaning liquid production device 11 related to a first embodiment of the present invention. The cleaning liquid production device 11 includes a liquid tank 12. The liquid tank 12 is filled with a liquid 13. The liquid 13 may employ not only pure water but also a liquid that uses water or an organic solvent as a solvent and has an electrolyte, a surfactant, a gas, etc. dissolved therein. Connected to the liquid tank 12 are a first gas bubble generating device 14 and a second gas bubble generating device 15.

The first gas bubble generating device 14 has a supply port 14*a* opening in the liquid 13. The first gas bubble generating device 14 shoots out fine gas bubbles into the liquid 13 via the supply port 14*a*. The fine gas bubbles include microbubbles and nanobubbles. The fine gas bubbles may be a collection of gas bubbles having an average diameter of a defined value or less. The diameter of the gas bubbles may be set based on the diameter of a fine hole provided in the supply port 14*a*. The diameter of the fine hole is set at no greater than 50 μm. The diameter of the gas bubbles is preferably no greater than 1 μm. Here, the first gas bubble generating device 14 shoots out a first fine gas bubble group formed from gas at a first temperature. The concentration of the gas bubbles having a diameter of no greater than 1 μm is desirably $1\times10^6$ or greater per milliliter.

A gas source 16*a* is connected to the first gas bubble generating device 14. The gas source 16*a* supplies gas to the first gas bubble generating device 14. The gas is not limited to air, nitrogen, hydrogen, etc. and may be any type of gas. A temperature regulating device 17*a* is connected to the gas source 16*a*. The temperature regulating device 17*a* regulates the temperature of the gas of the gas source 16*a*. When regulating the temperature in this way, thermal energy is applied to the gas from the temperature regulating device 17*a* (or the gas is deprived thereof). Thermal energy (either plus or minus) may be transferred to the gas by any method. Here, gas at the first temperature is supplied from the gas source 16*a* to the first gas bubble generating device 14.

Similarly, the second gas bubble generating device 15 has a supply port 15*a* opening in the liquid 13. The second gas bubble generating device 15 shoots out fine gas bubbles into the liquid 13 via the supply port 15*a*. The fine gas bubbles include microbubbles and nanobubbles. The fine gas bubbles may be a collection of gas bubbles having an average diameter of a defined value or less. The diameter of the gas bubbles may be set based on the diameter of a fine hole provided in the supply port 15*a*. The diameter of the fine hole is set at no greater than 50 μm. The diameter of the gas bubbles is preferably no greater than 1 μm. Here, the second gas bubble generating device 15 shoots out a second fine gas bubble group formed from gas at a second temperature that is lower than the first temperature. The diameter of the gas may not only be equal to that of the first gas bubble generating device 14 but may also be smaller or larger than that. The average diameter of the second fine gas bubble group is preferably smaller than the average diameter of the first fine gas bubble group. The concentration of the gas bubbles having a diameter of no greater than 1 μm is desirably $1\times10^6$ or greater per milliliter.

A gas source 16*b* is connected to the second gas bubble generating device 15. The gas source 16*b* supplies gas to the second gas bubble generating device 15. The gas is not limited to air, nitrogen, hydrogen, etc. and may be any type of gas. The type of gas may be the same as or different from that of the first gas bubble generating device 14. A temperature regulating device 17*b* is connected to the gas source 16*b*. The temperature regulating device 17*b* regulates the temperature of the gas of the gas source 16*b*. When regulating the temperature in this way, thermal energy is applied to the gas from the temperature regulating device 17*b* (or the gas is deprived thereof). Thermal energy (either plus or minus) may be transferred to the gas by any method. Here, gas at the second temperature is supplied from the gas source 16*b* to the second gas bubble generating device 15.

When such a cleaning liquid production device 11 operates, a first fine gas bubble group 18*a* formed from gas at the first temperature and a second fine gas bubble group 18*b* formed from gas at the second temperature are shot out into the liquid 13 in the liquid tank 12. As a result, a cleaning liquid including the first fine gas bubble group 18*a* formed from gas at the first temperature and the second fine gas bubble group 18*b* formed from gas at the second temperature in the single liquid 13 is produced. The temperature of the liquid 13 may be set freely to be at least the second temperature but no greater than the first temperature. When the liquid 13 is for example pure water or an aqueous solution, the temperature of the liquid 13 is desirably set at no greater than 80 degrees Celsius. If the temperature of the water or the aqueous solution exceeds 80 degrees Celsius, the gas bubbles cannot maintain a high numerical density in a stable manner.

(2) Cleaning Liquid Production Device Related to Second Embodiment

Figure 2:
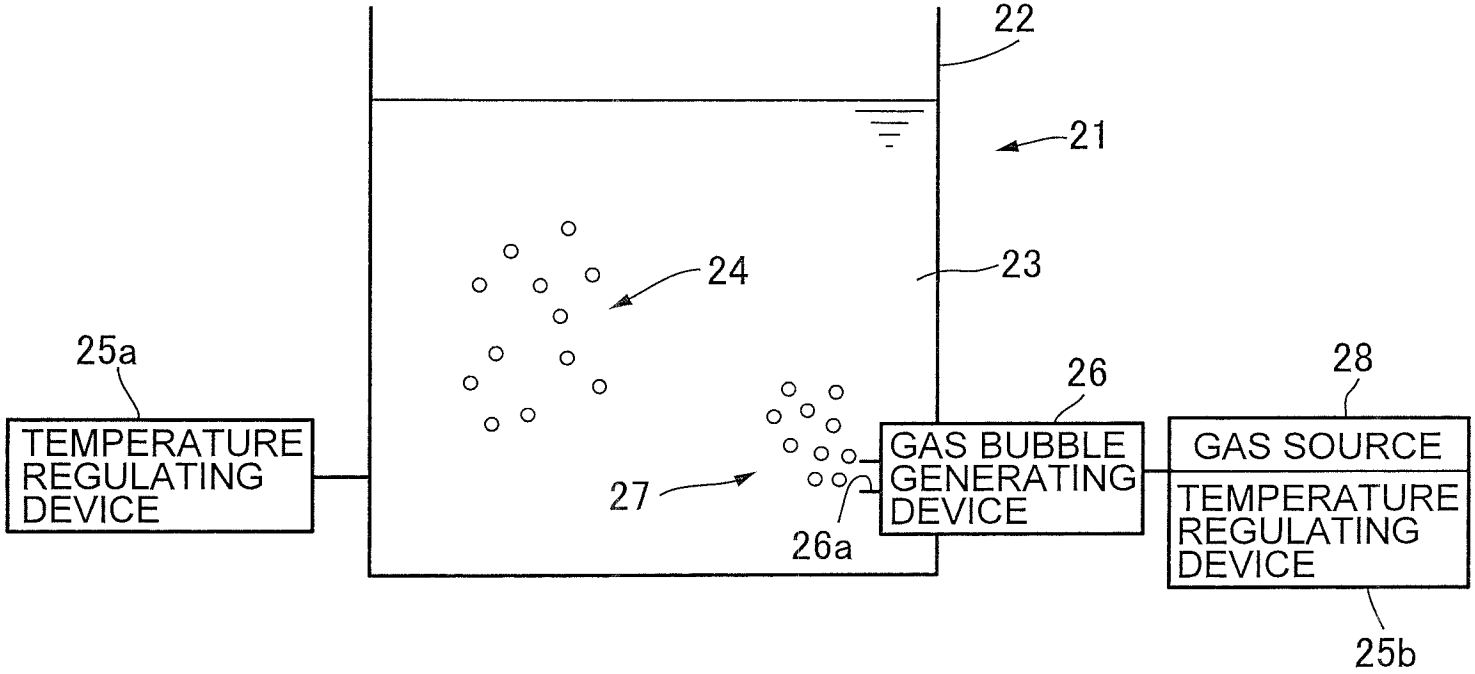
FIG. 2 is a schematic diagram showing an overall picture of a cleaning liquid production device related to a second embodiment.

FIG. 2 shows an overall picture of a cleaning liquid production device 21 related to a second embodiment. The cleaning liquid production device 21 includes a liquid tank 22. The liquid tank 22 is filled with a preliminary cleaning liquid 23. The preliminary cleaning liquid 23 has a first fine gas bubble group 24 included in a liquid and formed from a gas at a first temperature. The liquid may employ not only pure water but also a liquid that uses water or an organic solvent as a solvent and has an electrolyte, a surfactant, a gas, etc. dissolved therein. The first fine gas bubble group 24 includes microbubbles and nanobubbles. The first fine gas bubble group 24 may be a collection of gas bubbles having an average diameter of no greater than a defined value. The average diameter is set at no greater than 50 μm. The diameter of the gas bubbles may preferably be no greater than 1 μm. The gas is not limited to air, nitrogen, hydrogen, etc. and may be any type of gas. The concentration of gas bubbles having a diameter of no greater than 1 μm is desirably $1\times10^6$ or greater per milliliter.

A temperature regulating device 25*a* is connected to the liquid tank 22. The temperature regulating device 25*a* regulates the temperature of the preliminary cleaning liquid 23 within the liquid tank 22. When regulating the temperature in this way, thermal energy is applied to the preliminary cleaning liquid 23 from the temperature regulating device 25*a* (or the liquid is deprived thereof). Thermal energy (either plus or minus) may be transferred to the preliminary cleaning liquid 23 by any method. Here, the thermal energy is in equilibrium between the first fine gas bubble group 24 and the liquid in the preliminary cleaning liquid 23. Therefore, the temperature of the gas included in individual fine gas bubbles can be considered to be equal to a temperature measured as the preliminary cleaning liquid 23. Here, the temperature of the preliminary cleaning liquid 23 is maintained at the first temperature by virtue of the temperature regulating device 25*a*. The first temperature is desirably set at no greater than 80 degrees Celsius. When the liquid is for example pure water or an aqueous solution, if the temperature of the pure water or the aqueous solution exceeds 80 degrees Celsius, the gas bubbles cannot maintain a high numerical density in a stable manner.

A gas bubble generating device 26 is connected to the liquid tank 22. The gas bubble generating device 26 has a supply port 26*a* opening in the preliminary cleaning liquid 23. The gas bubble generating device 26 shoots out fine gas bubbles into the preliminary cleaning liquid 23 via the supply port 26*a*. The fine gas bubbles include microbubbles and nanobubbles. The fine gas bubbles may be a collection of gas bubbles having an average diameter of no greater than a defined value. The diameter of the gas bubbles may be set based on the diameter of a fine hole provided in the supply port 26*a*. The diameter of the fine hole is set at no greater than 50 μm. The diameter of the gas bubbles may preferably be no greater than 1 μm. Here, the gas bubble generating device 26 shoots out a second fine gas bubble group 27 formed from a gas at a second temperature that is lower than the first temperature. The diameter of the gas may not only be equal to but may also be smaller than or larger than that of the first fine gas bubble group 24 included in the preliminary cleaning liquid 23. The average diameter of the second fine gas bubble group 27 is preferably smaller than the average diameter of the first fine gas bubble group 24. The concentration of gas bubbles having a diameter of no greater than 1 μm is desirably $1\times10^6$ or greater per milliliter.

A gas source 28 is connected to the gas bubble generating device 26. The gas source 28 supplies gas to the gas bubble generating device 26. The gas is not limited to air, nitrogen, hydrogen, etc. and may be any type of gas. The type of gas may be the same as or different from that of the first fine gas bubble group 24. A temperature regulating device 25*b* is connected to the gas source 28. The temperature regulating device 25*b* regulates the temperature of the gas of the gas source 28. When regulating the temperature in this way, thermal energy is applied to the gas from the temperature regulating device 25*b* (or the gas is deprived thereof). Thermal energy (either plus or minus) may be transferred to the gas by any method. Here, gas at the second temperature is supplied from the gas source 28 to the gas bubble generating device 26.

When such a cleaning liquid production device 21 operates, the second fine gas bubble group 27 formed from the gas at the second temperature is shot out into the preliminary cleaning liquid 23 in the liquid tank 22. As a result, a cleaning liquid including the first fine gas bubble group 24 formed from the gas at the first temperature and the second fine gas bubble group 27 formed from the gas at the second temperature in a single liquid is produced. The temperature of the liquid may be set freely to be at least the second temperature but no greater than the first temperature. In the arrangement above, the first fine gas bubble group 24 formed from the gas at the first temperature is present in the preliminary cleaning liquid 23 in advance, and the second fine gas bubble group 27 formed from the gas at the second temperature, which is lower than the first temperature, is shot out into the preliminary cleaning liquid 23; conversely, the second fine gas bubble group 27 formed from the gas at the second temperature may be present in the preliminary cleaning liquid 23 in advance, and the first fine gas bubble group 24 formed from the gas at the first temperature may be shot out into the preliminary cleaning liquid 23.

(3) Cleaning Liquid Production Device Related to Third Embodiment

Figure 3:
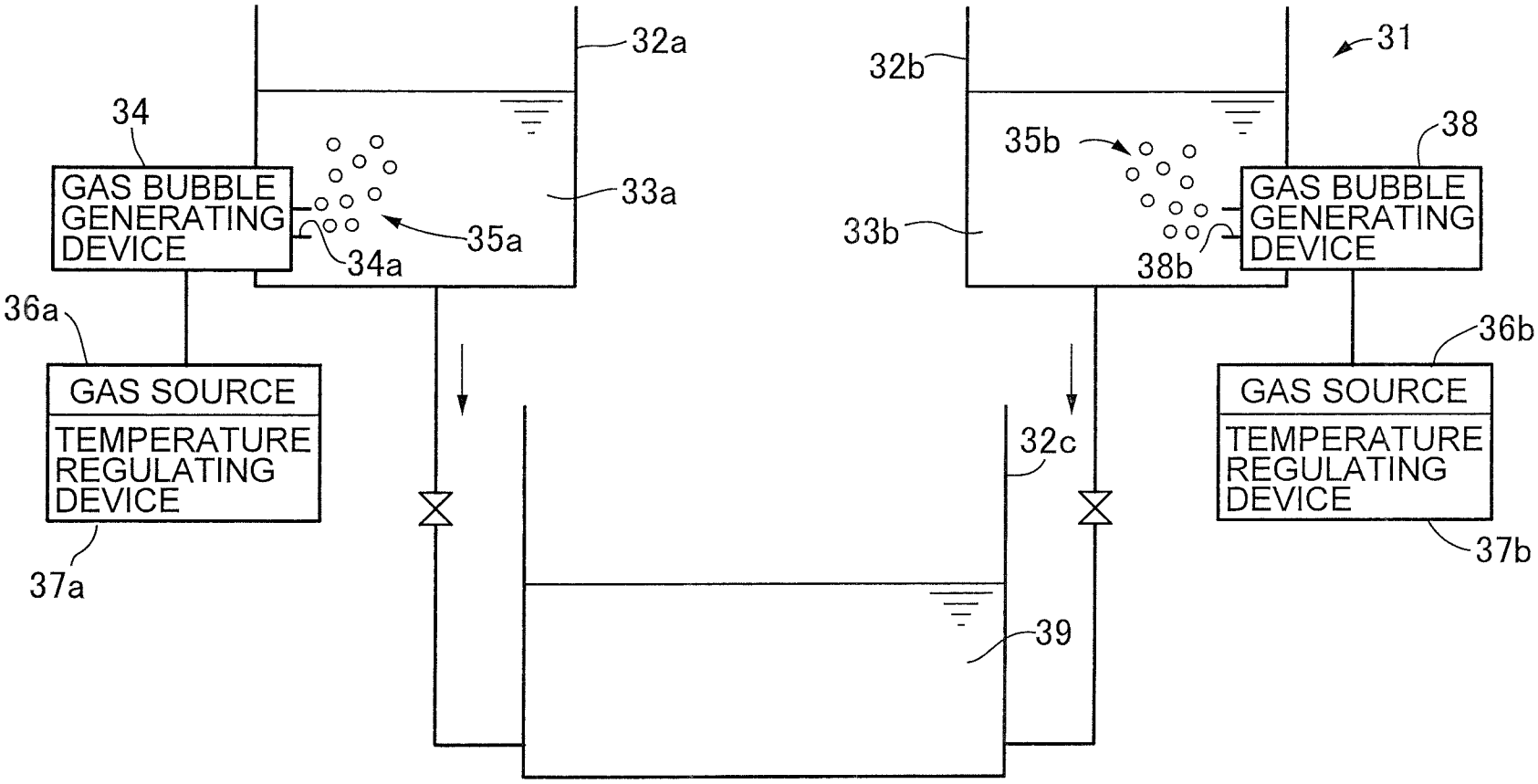
FIG. 3 is a schematic diagram showing an overall picture of a cleaning liquid production device related to a third embodiment.

FIG. 3 shows an overall picture of a cleaning liquid production device 31 related to a third embodiment. The cleaning liquid production device 31 includes a first liquid tank 32*a* and a second liquid tank 32*b*. The first liquid tank 32*a* is filled with a first preliminary cleaning liquid 33*a*. The second liquid tank 32*b* is filled with a second preliminary cleaning liquid 33*b*. A mixing vessel 32*c* is connected in common to the first liquid tank 32*a* and the second liquid tank 32*b*. The first preliminary cleaning liquid 33*a* from the first liquid tank 32*a* and the second preliminary cleaning liquid 33*b* from the second liquid tank 32*b* are introduced into the mixing vessel 32*c*. The first preliminary cleaning liquid 33*a* and the second preliminary cleaning liquid 33*b* are mixed in the mixing vessel 32*c*.

A first gas bubble generating device 34 is connected to the first liquid tank 32*a*. The first gas bubble generating device 34 has a supply port 34*a* opening in the liquid. The liquid may employ not only pure water but also a liquid that uses water or an organic solvent as a solvent and has an electrolyte, a surfactant, a gas, etc. dissolved therein. The first gas bubble generating device 34 shoots out fine gas bubbles into the liquid via the supply port 34*a*. The fine gas bubbles include microbubbles and nanobubbles. The fine gas bubbles may be a collection of gas bubbles having an average diameter of no greater than a defined value. The diameter of the gas bubbles may be set based on the diameter of a fine hole provided in the supply port 34*a*. The diameter of the fine hole is set at no greater than 50 μm. The diameter of the gas bubbles may preferably be no greater than 1 μm. Here, the first gas bubble generating device 34 shoots out a first fine gas bubble group 35*a* formed from the gas at a first temperature. The concentration of gas bubbles having a diameter of no greater than 1 μm is desirably $1\times10^6$ or greater per milliliter.

A gas source 36*a* is connected to the first gas bubble generating device 34. The gas source 36*a* supplies gas to the first gas bubble generating device 34. The gas is not limited to air, nitrogen, hydrogen, etc. and may be any type of gas. A temperature regulating device 37*a* is connected to the gas source 36*a*. The temperature regulating device 37*a* regulates the temperature of the gas of the gas source 36*a*. When regulating the temperature in this way, thermal energy is applied to the gas from the temperature regulating device 37*a* (or the gas is deprived thereof). Thermal energy (either plus or minus) may be transferred to the gas by any method. Here, gas at the first temperature is supplied from the gas source 36*a* to the first gas bubble generating device 34.

In this arrangement, a temperature regulating device may be connected to the first liquid tank 32*a*. The thermal energy is in equilibrium between the first fine gas bubble group 35*a* and the liquid in the first preliminary cleaning liquid 33*a*. The temperature of the gas included in individual fine gas bubbles can be considered to be equal to a temperature measured as the first preliminary cleaning liquid 33*a*. The temperature of the first preliminary cleaning liquid 33*a* may be maintained at the first temperature by virtue of the temperature regulating device.

Similarly, a second gas bubble generating device 38 is connected to the second liquid tank 32*b*. The second gas bubble generating device 38 has a supply port 38*a* opening in the liquid. The liquid may employ a liquid that uses water or an organic solvent as a solvent and has an electrolyte, a surfactant, a gas, etc. dissolved therein. The second gas bubble generating device 38 shoots out fine gas bubbles into the liquid via the supply port 38*a*. The fine gas bubbles include microbubbles and nanobubbles. The fine gas bubbles may be a collection of gas bubbles having an average diameter of no greater than a defined value. The diameter of the gas bubbles may be set based on the diameter of a fine hole provided in the supply port 38*a*. The diameter of the fine hole is set at no greater than 50 μm. The diameter of the gas bubbles may preferably be no greater than 1 μm. Here, the second gas bubble generating device 38 shoots out a second fine gas bubble group 35*b* formed from the gas at the second temperature, which is lower than the first temperature. The diameter of the gas may not only be equal to but may also be smaller than or larger than that of the first gas bubble generating device 34. The average diameter of the second fine gas bubble group is preferably smaller than the average diameter of the first fine gas bubble group. The concentration of gas bubbles having a diameter of no greater than 1 μm is desirably $1\times10^6$ or greater per milliliter.

A gas source 36*b* is connected to the second gas bubble generating device 38. The gas source 36*b* supplies gas to the second gas bubble generating device 38. The gas is not limited to air, nitrogen, hydrogen, etc. and may be any type of gas. The type of gas may be the same as or different from that of the first gas bubble generating device 34. A temperature regulating device 37*b* is connected to the gas source 36*b*. The temperature regulating device 37*b* regulates the temperature of the gas of the gas source 36*b*. When regulating the temperature in this way, thermal energy is applied to the gas from the temperature regulating device 37*b* (or the gas is deprived thereof). Thermal energy (either plus or minus) may be transferred to the gas by any method. Here, gas at the second temperature is supplied from the gas source 36*b* to the second gas bubble generating device 38.

In this arrangement, a temperature regulating device may be connected to the second liquid tank 32*b*. The thermal energy is in equilibrium between the second fine gas bubble group 35*b* and the liquid in the second preliminary cleaning liquid 33*b*. The temperature of the gas included in individual fine gas bubbles can be considered to be equal to a temperature measured as the second preliminary cleaning liquid 33*b*. The temperature of the second preliminary cleaning liquid 33*b* may be maintained at the second temperature by virtue of the temperature regulating device.

When such a cleaning liquid production device 31 operates, the first preliminary cleaning liquid 33*a* including the first fine gas bubble group 35*a* formed from the gas at the first temperature is produced in the first liquid tank 32*a*, and the second preliminary cleaning liquid 33*b* including the second fine gas bubble group 35*b* formed from the gas at the second temperature is produced in the second liquid tank 32*b*. As a result of the first preliminary cleaning liquid 33*a* and the second preliminary cleaning liquid 33*b* being mixed in the mixing vessel 32*c*, a cleaning liquid 39 including the first fine gas bubble group 35*a* formed from the gas at the first temperature and the second fine gas bubble group 35*b* formed from the gas at the second temperature in a single liquid is produced. The temperature of the liquid may be set freely to be at least the second temperature but no greater than the first temperature. When the liquid is for example pure water or an aqueous solution, the temperature of the liquid 13 is desirably set at no greater than 80 degrees Celsius. If the temperature of the pure water or the aqueous solution exceeds 80 degrees Celsius, the gas bubbles cannot maintain a high numerical density in a stable manner.

(4) Cleaning Device Related to Fourth Embodiment

Figure 4:
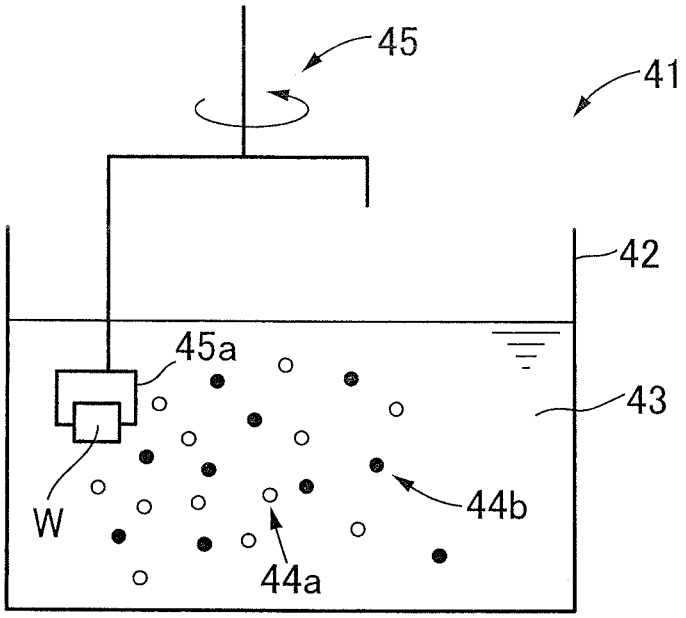
FIG. 4 is a schematic diagram showing an overall picture of a cleaning device related to a fourth embodiment.

FIG. 4 shows an overall picture of a cleaning device 41 related to a fourth embodiment of the present invention. The cleaning device 41 includes a cleaning tank 42. The cleaning tank 42 is filled with a cleaning liquid 43 related to any of the embodiments. The cleaning liquid 43 has a liquid, a first fine gas bubble group 44*a* included in the liquid and formed from a gas at a first temperature, and a second fine gas bubble group 44*b* included in the liquid and formed from a gas at a second temperature that is lower than the first temperature. Any of the liquids may employ not only pure water but also a liquid that uses water or an organic solvent as a solvent and has an electrolyte, a surfactant, a gas, etc. dissolved therein. The concentration of gas bubbles having a diameter of no greater than 1 μm is desirably $1\times10^6$ or greater per milliliter. The temperature of the liquid 13 is desirably set freely to be at least the second temperature but no greater than the first temperature. When the liquid is for example pure water or an aqueous solution, the temperature of the liquid is desirably set to be no greater than 80 degrees Celsius. If the temperature of the pure water or the aqueous solution exceeds 80 degrees Celsius, the gas bubbles cannot maintain a high numerical density in a stable manner.

The cleaning device 41 includes a stirring mechanism 45. The stirring mechanism 45 has a holder 45*a* for holding an object to be cleaned W. The holder 45*a* is immersed in the cleaning liquid 42. The stirring mechanism 45 drives the holder 45*a* so as to move the object to be cleaned W in the cleaning liquid 43 of the cleaning tank 42. In this way, the object to be cleaned W is exposed to the cleaning liquid 43. The cleaning liquid 43 is stirred accompanying the movement. The first fine gas bubble group 44*a* and the second fine gas bubble group 44*b* are mixed with each other in response to being stirred. The first fine gas bubble group 44*a* and the second fine gas bubble group 44*b* collide with the surface of the object to be cleaned W. Fine gas bubbles having different temperatures make contact one after another with the border (interface contour) between the surface of the object to be cleaned W and a contaminant. Due to the fine gas bubbles having different temperatures acting on the same position, a repeated temperature change (temperature oscillation) occurs at the interface contour. The temperature oscillation causes detachment at the interface. Fine gas bubbles penetrate into the inside from the contour accompanying the progress of detachment. In this way, the contaminant becomes detached from the surface of the object to be cleaned W. The contaminant is separated from the object to be cleaned W. By virtue of such temperature oscillation, the cleaning liquid 43 exhibits a remarkably better cleaning effect than ever before without necessarily utilizing the energy of collapsing gas bubbles.

(5) Cleaning Device Related to Fifth Embodiment

Figure 5:
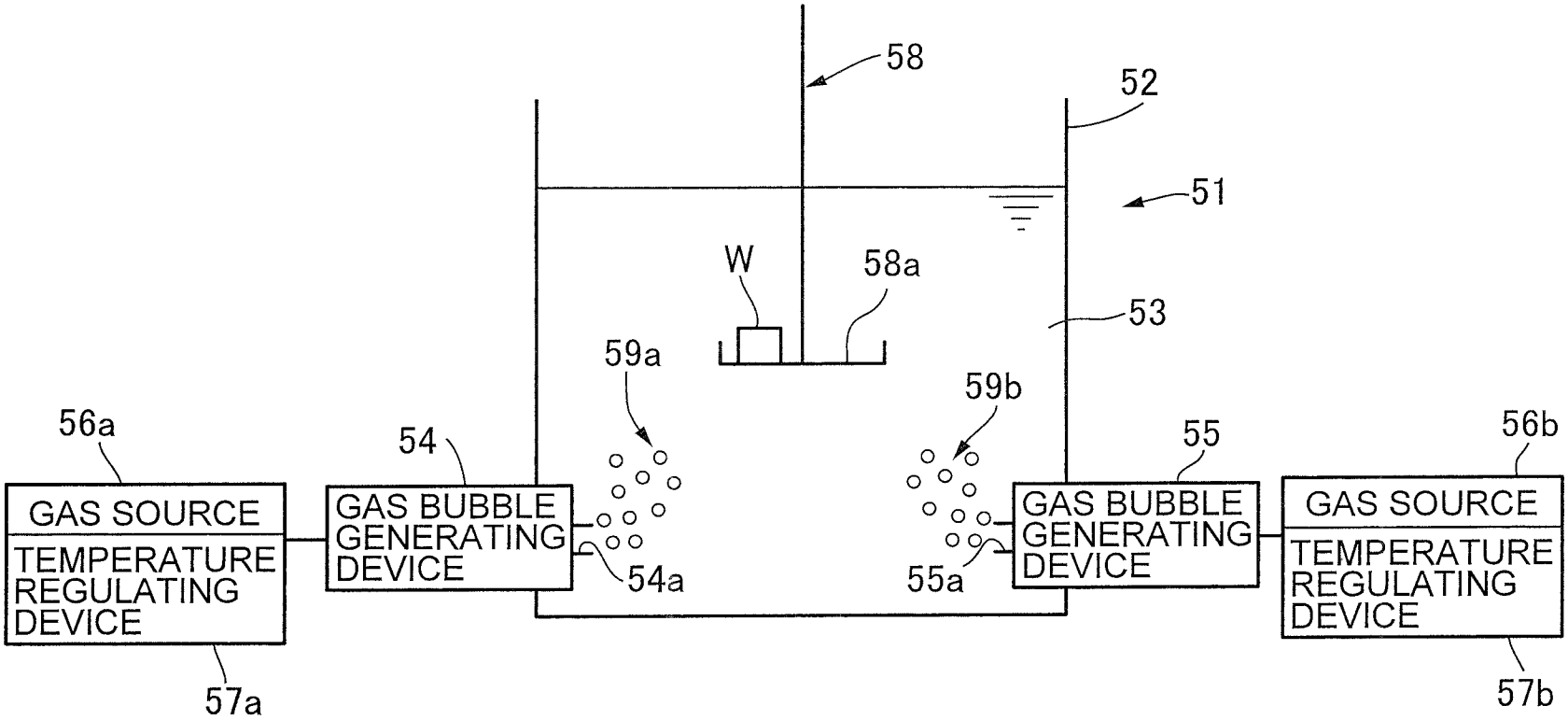
FIG. 5 is a schematic diagram showing an overall picture of a cleaning device related to a fifth embodiment.

FIG. 5 shows an overall picture of a cleaning device 51 related to a fifth embodiment. The cleaning device 51 includes a liquid tank 52. The liquid tank 52 is filled with a liquid 53. The liquid 53 may employ not only pure water but also a liquid that uses water or an organic solvent as a solvent and has an electrolyte, a surfactant, a gas, etc. dissolved therein. A first gas bubble generating device 54 and a second gas bubble generating device 55 are connected to the liquid tank 52.

The first gas bubble generating device 54 has a supply port 54*a* opening in the liquid 53. The first gas bubble generating device 54 shoots out fine gas bubbles into the liquid 53 via the supply port 54*a*. The fine gas bubbles include microbubbles and nanobubbles. The fine gas bubbles may be a collection of gas bubbles having an average diameter of no greater than a defined value. The diameter of the gas bubbles may be set based on the diameter of a fine hole provided in the supply port 54*a*. The diameter of the fine hole is set at no greater than 50 μm. The diameter of the gas bubbles may preferably be no greater than 1 μm. Here, the first gas bubble generating device 54 shoots out a first fine gas bubble group formed from gas at a first temperature. The concentration of gas bubbles having a diameter of no greater than 1 μm is desirably $1\times10^6$ or greater per milliliter.

A gas source 56*a* is connected to the first gas bubble generating device 54. The gas source 56*a* supplies gas to the first gas bubble generating device 54. The gas is not limited to air, nitrogen, hydrogen, etc. and may be any type of gas. A temperature regulating device 57*a* is connected to the gas source 56*a*. The temperature regulating device 57*a* regulates the temperature of the gas of the gas source 56*a*. When regulating the temperature in this way, thermal energy is applied to the gas from the temperature regulating device 57*a* (or the gas is deprived thereof). Thermal energy (either plus or minus) may be transferred to the gas by any method. Here, gas at the first temperature is supplied from the gas source 56*a* to the first gas bubble generating device 54.

Similarly, the second gas bubble generating device 55 has a supply port 55*a* opening in the liquid 53. The second gas bubble generating device 55 shoots out fine gas bubbles into the liquid 53 via the supply port 55*a*. The fine gas bubbles include microbubbles and nanobubbles. The fine gas bubbles may be a collection of gas bubbles having an average diameter of no greater than a defined value. The diameter of the gas bubbles may be set based on the diameter of a fine hole provided in the supply port 55*a*. The diameter of the fine hole is set at no greater than 50 μm. The diameter of the gas bubbles may preferably be no greater than 1 μm. Here, the second gas bubble generating device 55 shoots out a second fine gas bubble group formed from a gas at a second temperature that is lower than the first temperature. The diameter of the gas may not only be equal to but may also be smaller than or larger than that of the first gas bubble generating device 54. The average diameter of the second fine gas bubble group is preferably smaller than the average diameter of the first fine gas bubble group. The concentration of gas bubbles having a diameter of no greater than 1 μm is desirably $1\times10^6$ or greater per milliliter.

A gas source 56*b* is connected to the second gas bubble generating device 55. The gas source 56*b* supplies gas to the second gas bubble generating device 55. The gas is not limited to air, nitrogen, hydrogen, etc. and may be any type of gas. The type of gas may be the same as or different from that of the first gas bubble generating device 54. A temperature regulating device 57*b* is connected to the gas source 56*b*. The temperature regulating device 57*b* regulates the temperature of the gas of the gas source 56*b*. When regulating the temperature in this way, thermal energy is applied to the gas from the temperature regulating device 57*b* (or the gas is deprived thereof). Thermal energy (either plus or minus) may be transferred to the gas by any method. Here, the gas at the second temperature is supplied from the gas source 56*b* to the second gas bubble generating device 55.

The cleaning device 51 includes a holding mechanism 58. The holding mechanism 58 has a holder 58*a* that is immersed in the cleaning liquid within the cleaning tank 52. The holder 58*a* holds an object to be cleaned W. The holding mechanism 58 may drive the holder 58*a* in the cleaning liquid so as to move the object to be cleaned W in the cleaning liquid or may hold the object to be cleaned W in the cleaning liquid in a stationary state. In this way, the object to be cleaned W is exposed to the cleaning liquid.

When the cleaning device 51 operates, a first fine gas bubble group 59*a* and a second fine gas bubble group 59*b* are each shot out toward the object to be cleaned W. As a result, a cleaning liquid including in the liquid 53 the first fine gas bubble group 59*a* formed from the gas at the first temperature and the second fine gas bubble group 59*b* formed from the gas at the second temperature is produced. The first fine gas bubble group 59*a* and the second fine gas bubble group 59*b* thus shot out collide with the object to be cleaned W. Fine gas bubbles having different temperatures make contact one after another with the border (interface contour) between the surface of the object to be cleaned W and a contaminant. Due to the fine gas bubbles having different temperatures acting on the same position, a repeated temperature change occurs at the interface contour (temperature oscillation). The temperature oscillation causes detachment at the interface. Fine gas bubbles penetrate into the inside from the contour accompanying the progress of detachment. In this way, the contaminant becomes detached from the surface of the object to be cleaned W. The contaminant is separated from the object to be cleaned W. By virtue of such temperature oscillation, the cleaning liquid exhibits a remarkably better cleaning effect than ever before without necessarily utilizing the energy of collapsing gas bubbles. The temperature of the liquid 53 may be set freely to be at least the second temperature but no greater than the first temperature. When the liquid 53 is for example pure water or an aqueous solution, the temperature of the liquid 53 is desirably set at no greater than 80 degrees Celsius. If the temperature of the pure water or the aqueous solution exceeds 80 degrees Celsius, the gas bubbles cannot maintain a high numerical density in a stable manner.

(6) Cleaning Device Related to Sixth Embodiment

Figure 6:
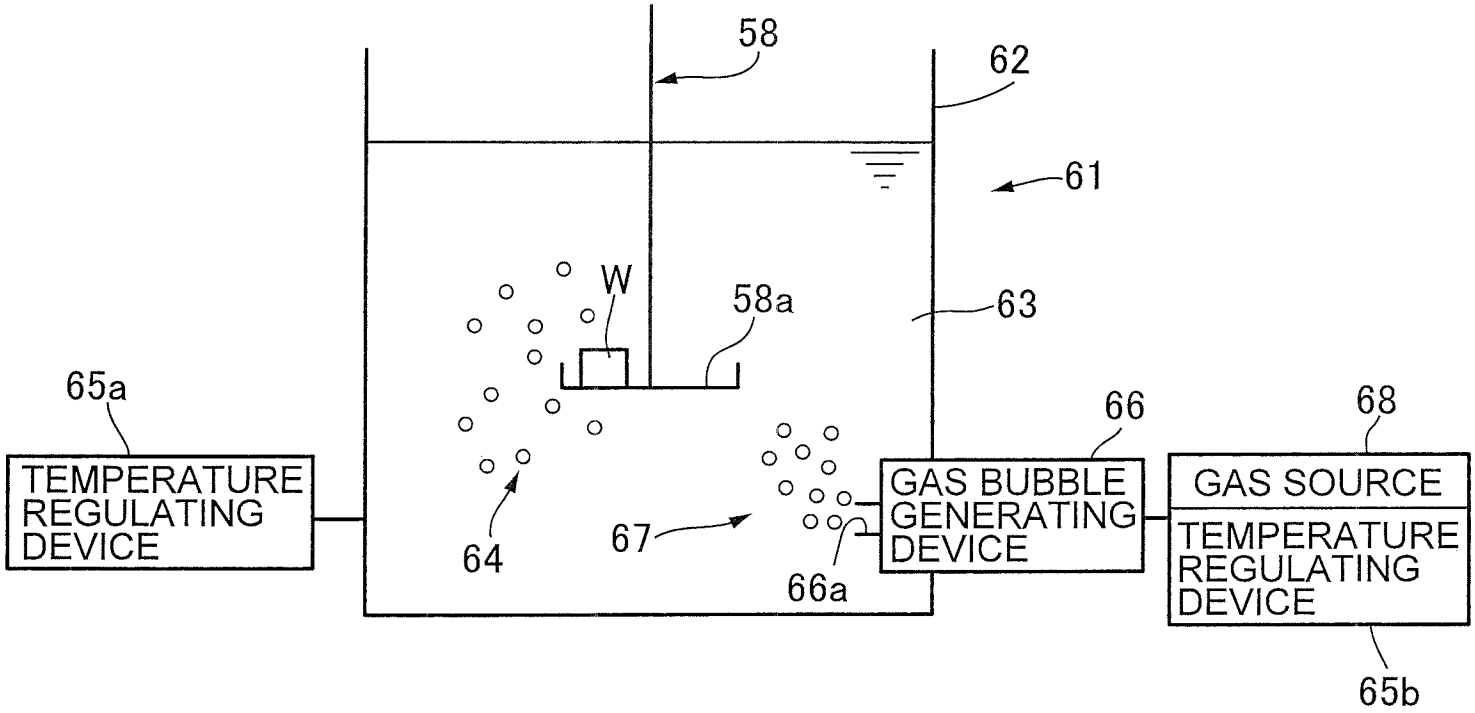
FIG. 6 is a schematic diagram showing an overall picture of a cleaning device related to a sixth embodiment.

FIG. 6 shows an overall picture of a cleaning device 61 related to a sixth embodiment. The cleaning device 61 includes a cleaning tank 62. The cleaning tank 62 is filled with a preliminary cleaning liquid 63. The preliminary cleaning liquid 63 has a first fine gas bubble group 64 included in a liquid and formed from a gas at a first temperature. The liquid may employ not only pure water but also a liquid that uses water or an organic solvent as a solvent and has an electrolyte, a surfactant, a gas, etc. dissolved therein. The first fine gas bubble group 64 includes microbubbles and nanobubbles. The first fine gas bubble group 64 may be a collection of gas bubbles having an average diameter of no greater than a defined value. The average diameter is set at no greater than 50 μm. The diameter of the gas bubbles may preferably be no greater than 1 μm. The gas is not limited to air, nitrogen, hydrogen, etc. and may be any type of gas. The concentration of gas bubbles having a diameter of no greater than 1 μm is desirably $1\times10^6$ or greater per milliliter.

A temperature regulating device 65*a* is connected to the cleaning tank 62. The temperature regulating device 65*a* regulates the temperature of the preliminary cleaning liquid 63 within the cleaning tank 62. When regulating the temperature in this way, thermal energy is applied to the preliminary cleaning liquid 63 from the temperature regulating device 65*a* (or the liquid is deprived thereof). Thermal energy (either plus or minus) may be transferred to the preliminary cleaning liquid 63 by any method. Here, the thermal energy is in equilibrium between the first fine gas bubble group 64 and the liquid in the preliminary cleaning liquid 63. Therefore, the temperature of the gas included in individual fine gas bubbles can be considered to be equal to a temperature measured as the preliminary cleaning liquid 63. Here, the temperature of the preliminary cleaning liquid 63 is maintained at a first temperature by virtue of the temperature regulating device 65*a*. The first temperature is desirably set at no greater than 80 degrees Celsius. When the liquid is for example pure water or an aqueous solution, if the temperature of the pure water or the aqueous solution exceeds 80 degrees Celsius, the gas bubbles cannot maintain a high numerical density in a stable manner.

A gas bubble generating device 66 is connected to the cleaning tank 62. The gas bubble generating device 66 has a supply port 66*a* opening in the preliminary cleaning liquid 63. The gas bubble generating device 66 shoots out fine gas bubbles into the preliminary cleaning liquid 63 via the supply port 66*a*. The fine gas bubbles include microbubbles and nanobubbles. The fine gas bubbles may be a collection of gas bubbles having an average diameter of no greater than a defined value. The diameter of the gas bubbles may be set based on the diameter of a fine hole provided in the supply port 66*a*. The diameter of the fine hole is set at no greater than 50 μm. The diameter of the gas bubbles may preferably be no greater than 1 μm. Here, the gas bubble generating device 66 shoots out a second fine gas bubble group 67 formed from a gas at a second temperature that is lower than the first temperature. The diameter of the gas may not only be equal to but may also be smaller than or larger than that of the first fine gas bubble group 64 included in the preliminary cleaning liquid 63. The average diameter of the second fine gas bubble group 67 is preferably smaller than the average diameter of the first fine gas bubble group 64. The concentration of gas bubbles having a diameter of no greater than 1 μm is desirably $1\times10^6$ or greater per milliliter.

A gas source 68 is connected to the gas bubble generating device 66. The gas source 68 supplies gas to the gas bubble generating device 66. The gas is not limited to air, nitrogen, hydrogen, etc. and may be any type of gas. The type of gas may be the same as or different from that of the first fine gas bubble group 64. A temperature regulating device 65*b* is connected to the gas source 68. The temperature regulating device 65*b* regulates the temperature of the gas of the gas source 68. When regulating the temperature in this way, thermal energy is applied to the gas from the temperature regulating device 65*b* (or the gas is deprived thereof). Thermal energy (either plus or minus) may be transferred to the gas by any method. Here, gas at the second temperature is supplied from the gas source 68 to the gas bubble generating device 66.

The cleaning device 61 includes a holding mechanism 58. The holding mechanism 58 has a holder 58*a* immersed in the cleaning liquid within the cleaning tank 62. The holder 58*a* holds an object to be cleaned W. The holding mechanism 58 may drive the holder 58*a* in the cleaning liquid so as to move the object to be cleaned W in the cleaning liquid or may hold the object to be cleaned W in the cleaning liquid in a stationary state. In this way, the object to be cleaned W is exposed to the cleaning liquid.

When carrying out cleaning, the cleaning tank 62 is filled with the preliminary cleaning liquid 63. The temperature of the preliminary cleaning liquid 63 is maintained at the first temperature. Here, the object to be cleaned W is immersed in the preliminary cleaning liquid 63. When the cleaning device 61 operates, the second fine gas bubble group 67 formed from the gas at the second temperature is shot out toward the object to be cleaned W. As a result, a cleaning liquid including in the liquid the first fine gas bubble group 64 formed from the gas at the first temperature and the second fine gas bubble group 67 formed from the gas at the second temperature is produced. The temperature of the liquid may be set freely to be at least the second temperature but no greater than the first temperature. The first fine gas bubble group 64 caught up in the second fine gas bubble group 67 thus shot out and the second fine gas bubble group 67 collide with the object to be cleaned W. The fine gas bubbles having different temperatures make contact one after another with the border (interface contour) between a contaminant and the surface of the object to be cleaned W. Due to the fine gas bubbles having different temperatures acting on the same position, a repeated temperature change occurs at the interface contour (temperature oscillation). The temperature oscillation causes detachment at the interface. Fine gas bubbles penetrate into the inside from the contour accompanying the progress of detachment. In this way, the contaminant becomes detached from the surface of the object to be cleaned W. The contaminant is separated from the object to be cleaned W. By virtue of such temperature oscillation, the cleaning liquid exhibits a remarkably better cleaning effect than ever before without necessarily utilizing the energy of collapsing gas bubbles. In the above, the first fine gas bubble group 64 formed from the gas at the first temperature is present in the preliminary cleaning liquid 63 in advance, and the second fine gas bubble group 67 formed from the gas at the second temperature, which is lower than the first temperature, is shot out into the preliminary cleaning liquid 63; conversely, the second fine gas bubble group 67 formed from the gas at the second temperature may be present in the preliminary cleaning liquid 63 in advance, and the first fine gas bubble group 64 formed from the gas at the first temperature may be shot out into the preliminary cleaning liquid 63.

(7) Cleaning Device Related to Seventh Embodiment

Figure 7:
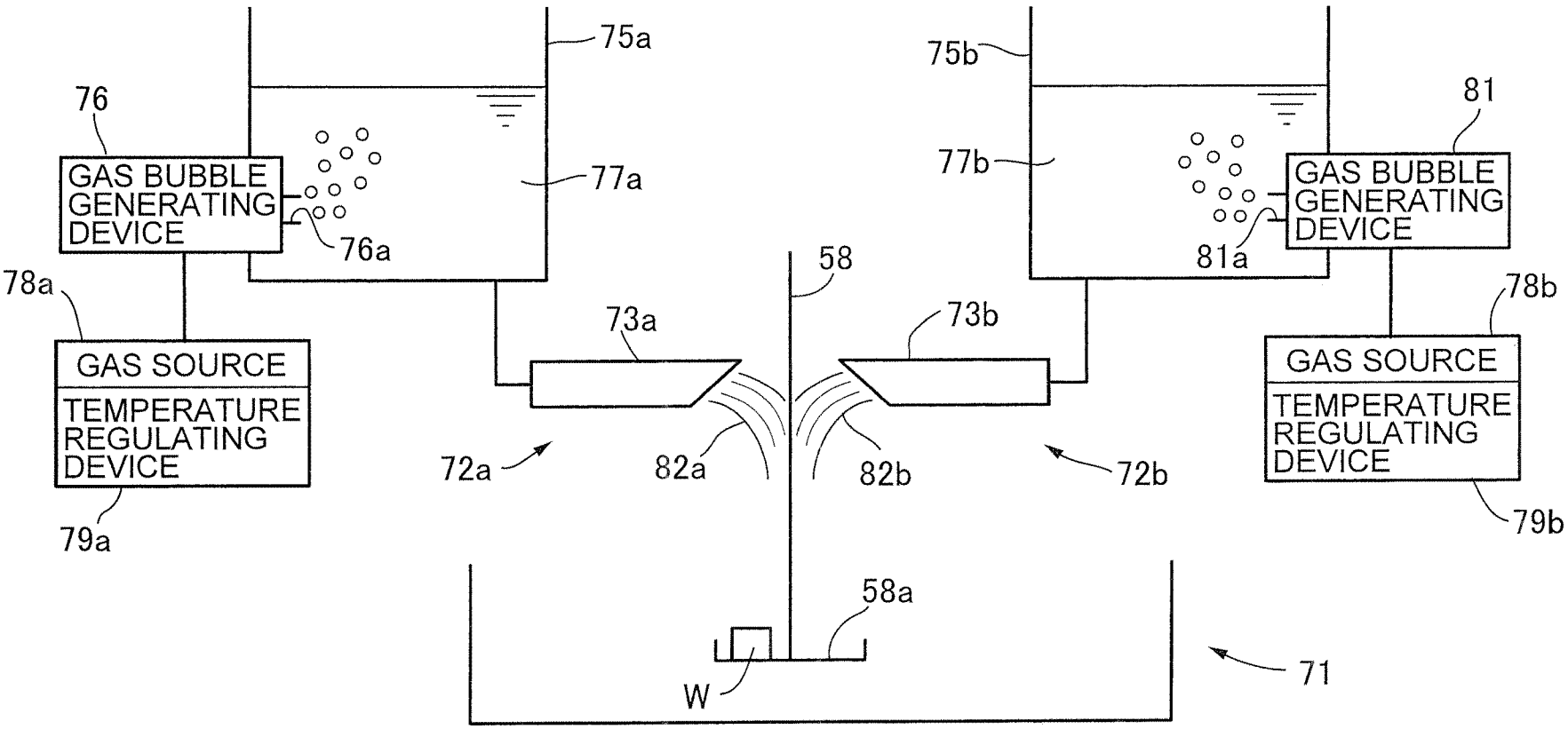
FIG. 7 is a schematic diagram showing an overall picture of a cleaning device related to a seventh embodiment.

FIG. 7 shows an overall picture of a cleaning device 71 related to a seventh embodiment. The cleaning device 71 includes a first liquid supply device 72*a* and a second liquid supply device 72*b*. The first liquid supply device 72*a* includes a first spout pipe 73*a* shooting out a first preliminary cleaning liquid. The second liquid supply device 72*b* includes a second spout pipe 73*b* shooting out a second preliminary cleaning liquid. A common holding mechanism 58 is disposed in the shooting out direction of the first spout pipe 73*a* and the shooting out direction of the second spout pipe 73*b*. The holding mechanism 58 includes a holder 58*a* holding an object to be cleaned W. A receiving vessel 74 may be installed beneath the holder 58*a* in the direction of gravity. The first preliminary cleaning liquid shot out from the first spout pipe 73*a* and the second preliminary cleaning liquid shot out from the second spout pipe 73*b* may be combined at the position of the holder 58*a*.

A first liquid tank 75*a* is connected to the first liquid supply device 72*a*. The first preliminary cleaning liquid is supplied from the first liquid tank 75*a* to the first liquid supply device 72*a*. A first gas bubble generating device 76 is connected to the first liquid tank 75*a*. The first gas bubble generating device 76 has a supply port 76*a* opening in a liquid 77*a*. The liquid 77*a* may employ not only pure water but also a liquid that uses water or an organic solvent as a solvent and has an electrolyte, a surfactant, a gas, etc. dissolved therein. The first gas bubble generating device 76 shoots out fine gas bubbles into the liquid 77*a* via the supply port 76*a*. The fine gas bubbles include microbubbles and nanobubbles. The fine gas bubbles may be a collection of gas bubbles having an average diameter of no greater than a defined value. The diameter of the gas bubbles may be set based on the diameter of a fine hole provided in the supply port 76*a*. The diameter of the fine hole is set at no greater than 50 μm. The diameter of the gas bubbles may preferably be no greater than 1 μm. Here, the first gas bubble generating device 76 shoots out a first fine gas bubble group formed from a gas at a first temperature. The concentration of gas bubbles having a diameter of no greater than 1 μm is desirably $1\times10^6$ or greater per milliliter.

A gas source 78*a* is connected to the first gas bubble generating device 76. The gas source 78*a* supplies gas to the first gas bubble generating device 76. The gas is not limited to air, nitrogen, hydrogen, etc. and may be any type of gas. A temperature regulating device 79*a* is connected to the gas source 78*a*. The temperature regulating device 79*a* regulates the temperature of the gas of the gas source 78*a*. When regulating the temperature in this way, thermal energy is applied to the gas from the temperature regulating device 79*a* (or the gas is deprived thereof). Thermal energy (either plus or minus) may be transferred to the gas by any method. Here, gas at the first temperature is supplied from the gas source 78*a* to the first gas bubble generating device 76.

In this arrangement, a temperature regulating device may be connected to the first liquid tank 75*a*. The thermal energy is in equilibrium between the first fine gas bubble group and the liquid in the first preliminary cleaning liquid. The temperature of the gas included in individual fine gas bubbles can be considered to be equal to a temperature measured as the first preliminary cleaning liquid. The temperature of the first preliminary cleaning liquid may be maintained at the first temperature by virtue of the temperature regulating device.

Similarly, a second liquid tank 75*b* is connected to the second liquid supply device 72*b*. The second preliminary cleaning liquid is supplied from the second liquid tank 75*b* to the second liquid supply device 72*b*. A second gas bubble generating device 81 is connected to the second liquid tank 75*b*. The second gas bubble generating device 81 has a supply port 81*a* opening in a liquid 77*b*. The liquid 77*b* may employ not only pure water but also a liquid that uses water or an organic solvent as a solvent and has an electrolyte, a surfactant, a gas, etc. dissolved therein. The second gas bubble generating device 81 shoots out fine gas bubbles into the liquid 77*b* via the supply port 81*a*. The fine gas bubbles include microbubbles and nanobubbles. The fine gas bubbles may be a collection of gas bubbles having an average diameter of no greater than a defined value. The diameter of the gas bubbles may be set based on the diameter of a fine hole provided in the supply port 81*a*. The diameter of the fine hole is set at no greater than 50 μm. The diameter of the gas bubbles may preferably be no greater than 1 μm. Here, the second gas bubble generating device 81 shoots out the second fine gas bubble group formed from the gas at the second temperature, which is higher than the first temperature. The diameter of the gas bubbles may not only be equal to but may also be smaller than or larger than that of the first gas bubble generating device 76. The average diameter of the second fine gas bubble group is preferably smaller than the average diameter of the first fine gas bubble group. The concentration of gas bubbles having a diameter of no greater than 1 μm is desirably $1\times10^6$ or greater per milliliter.

A gas source 78*b* is connected to the second gas bubble generating device 81. The gas source 78*b* supplies gas to the second gas bubble generating device 81. The gas is not limited to air, nitrogen, hydrogen, etc. and may be any type of gas. The type of gas may be the same as or different from that of the first gas bubble generating device 76. A temperature regulating device 79*b* is connected to the gas source 78*b*. The temperature regulating device 79*b* regulates the temperature of the gas of the gas source 78*b*. When regulating the temperature in this way, thermal energy is applied to the gas from the temperature regulating device 79*b* (or the gas is deprived thereof). Thermal energy (either plus or minus) may be transferred to the gas by any method. Here, gas at the second temperature is supplied from the gas source 78*b* to the second gas bubble generating device 81.

In this arrangement, a temperature regulating device may be connected to the second liquid tank 75*b*. The thermal energy is in equilibrium between the second fine gas bubble group and the liquid in the second preliminary cleaning liquid. The temperature of the gas included in individual fine gas bubbles can be considered to be equal to a temperature measured as the second preliminary cleaning liquid. The temperature of the second preliminary cleaning liquid may be maintained at the second temperature by virtue of the temperature regulating device.

When carrying out cleaning, the object to be cleaned W is set in the holder 58*a*. When the cleaning device 71 operates, a first preliminary cleaning liquid 82*a* and a second preliminary cleaning liquid 82*b* are made to shoot out from the first spout pipe 73*a* and the second spout pipe 73*b* respectively toward the object to be cleaned W. The first preliminary cleaning liquid 82*a* and the second preliminary cleaning liquid 82*b* are mixed and splashed over the object to be cleaned W. As a result, a cleaning liquid including in the liquid the first fine gas bubble group formed from the gas at the first temperature and the second fine gas bubble group formed from the gas at the second temperature is produced in the liquid. The first fine gas bubble group and the second fine gas bubble group collide with the object to be cleaned W. The fine gas bubbles having different temperatures make contact one after another with the border (interface contour) between the surface of the object to be cleaned W and a contaminant. Due to the fine gas bubbles having different temperatures acting on the same position, a repeated temperature change occurs at the interface contour (temperature oscillation). The temperature oscillation causes detachment at the interface. Fine gas bubbles penetrate into the inside from the contour accompanying the progress of detachment. In this way, the contaminant becomes detached from the surface of the object to be cleaned W. The contaminant is separated from the object to be cleaned W. By virtue of such temperature oscillation, the cleaning liquid exhibits a remarkably better cleaning effect than ever before without necessarily utilizing the energy of collapsing gas bubbles. The temperature of the liquid may be set freely to be at least the second temperature but no greater than the first temperature. When the liquid is for example pure water or an aqueous solution, the temperature of the liquid is desirably set at no greater than 80 degrees Celsius. If the temperature of the pure water or the aqueous solution exceeds 80 degrees Celsius, the gas bubbles cannot maintain a high numerical density in a stable manner.

(8) Eighth Embodiment

In all of the above embodiments, a combination of microbubbles and nanobubbles can be used as the first fine gas bubble group and the second fine gas bubble group. That is, either of the first fine gas bubble group and the second fine gas bubble group may employ microbubbles, and the other may employ nanobubbles. Due to the difference in the amount of thermal energy included in individual gas bubbles, the nanobubbles generate a gentle temperature change at the interface between the object to be cleaned W and a contaminant, and the microbubbles generate a rapid temperature change at the interface between the object to be cleaned W and a contaminant. The rapid temperature change causes rapid expansion of the object or rapid compression of the object, thus accelerating detachment of the contaminant.

(9) Verification

The present inventors carried out verification in accordance with the cleaning device 51 related to the fifth embodiment described above. In the verification, temperature conditions were examined for the liquid 53, the first fine gas bubble group 59*a* and the second fine gas bubble group 59*b*. The liquid 53 employed pure water. For the examination, the liquid tank 52 was filled with 50 L of pure water. The temperature (=TL) of the pure water was regulated. Atmosphere (air) was supplied to the first gas bubble generating device 54 from the gas source 56*a*. The temperature (first temperature T1) of the air was regulated. The amount of fine gas bubbles was set at on the order of $1\times10^6$ per milliliter. The diameter of the fine gas bubbles was set at approximately 500 nm. A film having pores with a diameter of 500 nm was used when forming the fine gas bubbles. The first fine gas bubble group 59*a* was continuously shot out over 10 minutes.

Atmosphere (air) was supplied to the second gas bubble generating device 55 from the gas source 56*b*. The temperature (second temperature T2) of the air was regulated. The amount of fine gas bubbles was set at on the order of $1\times10^6$ per milliliter. The diameter of the fine gas bubbles was set at approximately 500 nm. A film having pores with a diameter of 500 nm was used when forming the fine gas bubbles. The second fine gas bubble group 59*b* was continuously shot out over 10 minutes.

The holder 58*a* employed a basket. A machine component was mounted on the basket as the object to be cleaned W. Swarf became attached to the surface of the machine component together with oil at the time of cutting machining. After carrying out cleaning for 10 minutes, the amount of swarf and the amount of oil remaining on the surface of the machine component were measured. When measuring the amount of swarf, the machine component cleaned as above was subjected to high pressure cleaning. Swarf thus washed away was collected on a filter paper. The weight [milligrams] of swarf thus collected was measured using an electronic balance. On the other hand, when measuring the amount of oil, the cleaned machine component was immersed in a solvent. The concentration [ppm] of oil dissolved in the solvent was measured.

When examining the temperature conditions, six types of conditions were set as follows.

TABLE 1

| | First temperature T1 | Second temperature T2 | Liquid temperature TL |
|---|---|---|---|
| Condition 1 | 60° C. | 50° C. | 40° C. |
| Condition 2 | 30° C. | 20° C. | 40° C. |
| Condition 3 | 45° C. | 35° C. | 40° C. |
| Condition 4 | 50° C. | 40° C. | 40° C. |
| Condition 5 | 40° C. | 30° C. | 40° C. |
| Condition 6 | 60° C. | 20° C. | 40° C. |

In Condition 1 to Condition 5, a temperature difference of 10 degrees Celsius was set between the first temperature T1 and the second temperature T2. In Condition 1 the liquid temperature TL was set to be lower than the first temperature T1 and the second temperature T2. In Condition 2 the liquid temperature TL was set to be higher than the first temperature T1 and the second temperature T2. In Condition 3 the liquid temperature TL was set to be lower than the first temperature T1 but higher than the second temperature T2. In Condition 4 the liquid temperature TL was set equal to the second temperature T2, which was lower than the first temperature T1. In Condition 5 the liquid temperature TL was set equal to the first temperature T1, which was higher than the second temperature T2. In Condition 6 a temperature difference of 40 degrees Celsius was set between the first temperature T1 and the second temperature T2. In Condition 6 the liquid temperature TL was set to be lower than the first temperature T1 but higher than the second temperature T2. In Condition 1 and Condition 6 the first temperature T1 was set at the highest air temperature among all of the conditions. In Condition 2 and Condition 6 the second temperature T2 was set at the lowest air temperature among all of the conditions.

When examining the temperature conditions, the present inventors set three types of Comparative conditions. In all of the Comparative conditions the first temperature T1, the second temperature T2, and the liquid temperature TL were set equal.

TABLE 2

| | First temperature T1 | Second temperature T2 | Liquid temperature TL |
|---|---|---|---|
| Comparative condition 1 | 30° C. | 30° C. | 30° C. |
| Comparative condition 2 | 20° C. | 20° C. | 20° C. |
| Comparative condition 3 | 50° C. | 50° C. | 50° C. |

Figure 8:
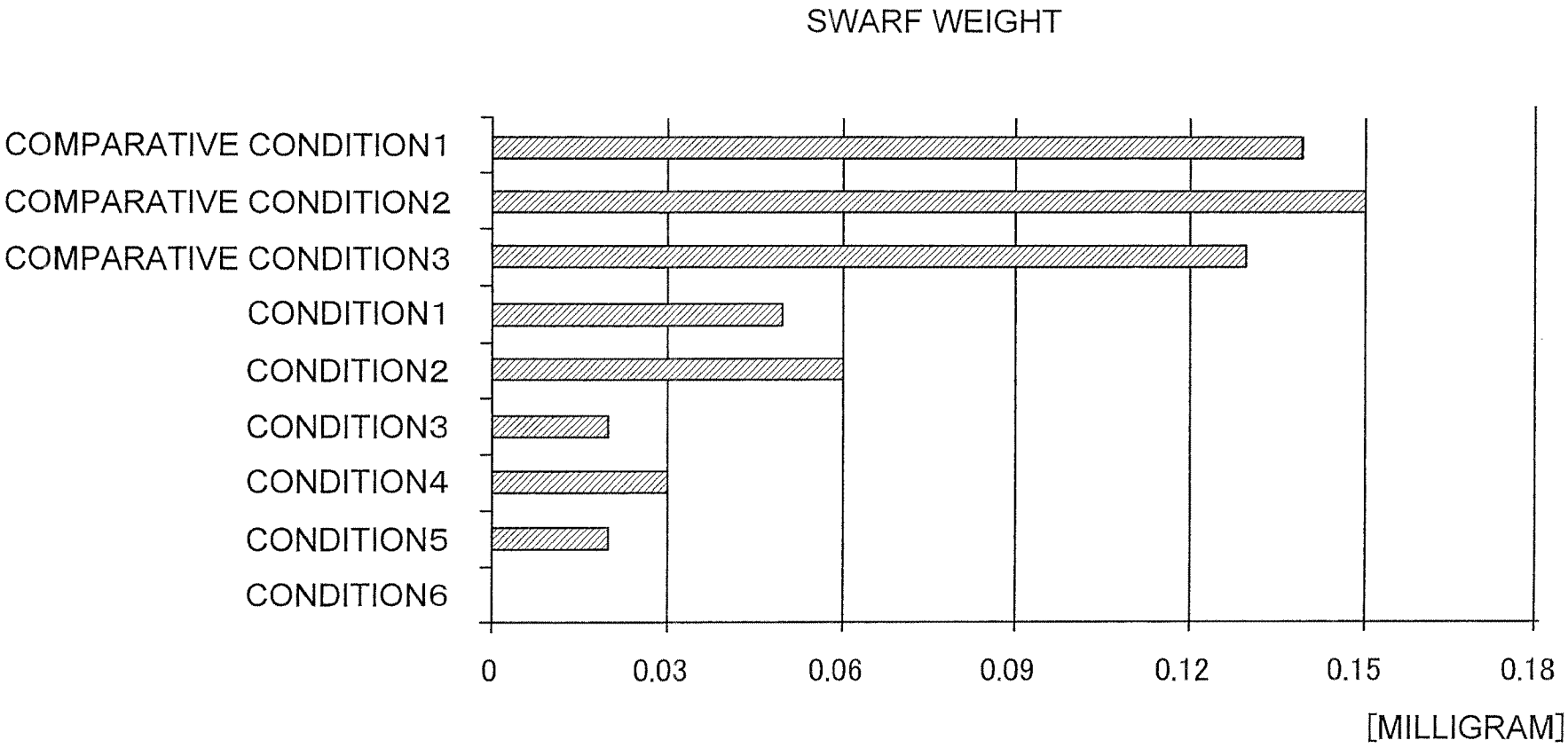
FIG. 8 is a graph showing the relationship between temperature conditions and swarf weight remaining.

From the results of examination, as shown in FIG. 8, it has been confirmed that in Conditions 1 to 6 the removal of swarf is greatly promoted compared with Comparative conditions 1 to 3. In particular, as is clear from Conditions 1 and 2, it has been confirmed that when a temperature difference is set between the first temperature T1 and the second temperature T2 the cleaning effect for swarf is enhanced. Furthermore, as is clear from Conditions 3 to 5, it has been confirmed that when the liquid temperature TL is set between the first temperature T1 and the second temperature T2 (including the first temperature T1 and the second temperature T2), the cleaning effect for swarf is further enhanced. Moreover, as is clear from Condition 6 it has been confirmed that the larger the temperature difference between the first temperature T1 and the second temperature T2, the higher the cleaning effect for swarf. In Condition 6 only less than 0.01 milligram of swarf remained. Therefore, it has been confirmed that when the temperature difference is sufficiently large, most of the swarf is washed away.

Figure 9:
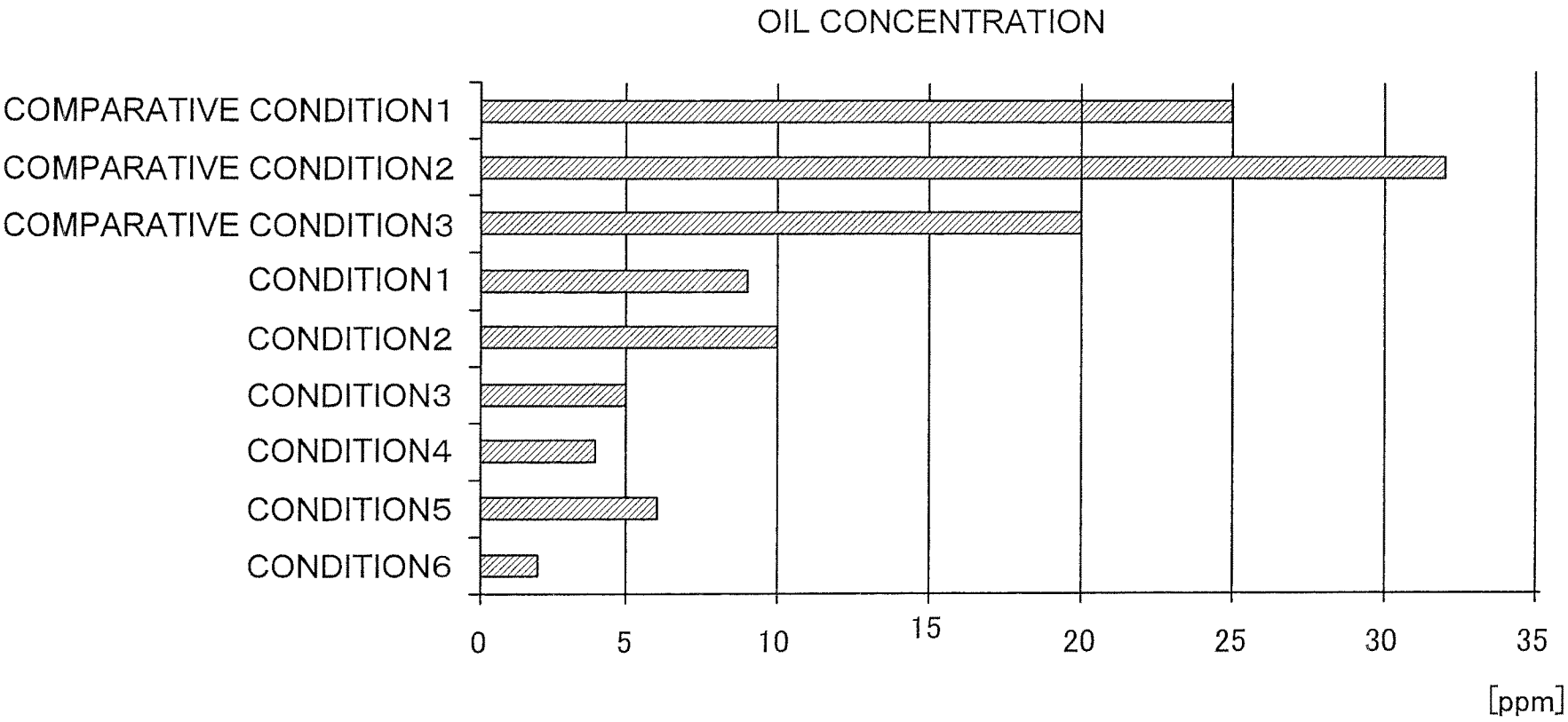
FIG. 9 is a graph showing the relationship between temperature conditions and recovered oil concentration in a solvent.

As shown in FIG. 9, it has been confirmed that in Conditions 1 to 6 the removal of oil is greatly promoted compared with Comparative conditions 1 to 3. In particular, as is clear from Conditions 1 and 2, it has been confirmed that when a temperature difference is set between the first temperature T1 and the second temperature T2, the cleaning effect for oil is enhanced. Furthermore, as is clear from Conditions 3 to 5, it has been confirmed that when the liquid temperature TL is set to be between the first temperature T1 and the second temperature T2 (including the first temperature T1 and the second temperature T2), the cleaning effect for oil is further enhanced. Moreover, as is clear from Condition 6, it has been confirmed that the larger the temperature difference between the first temperature T1 and the second temperature T2, the higher the cleaning effect for oil. It is surmised that the higher the air temperature, the higher the cleaning effect for oil.

Subsequently, the present inventors examined the relationship between the cleaning effect and the amount of gas bubbles (gas bubble density) of the gas bubble groups 59*a* and 59*b*. Similarly to the above, examination was carried out in accordance with the cleaning device 51 related to the fifth embodiment described above. Temperature conditions of Condition 3 above were set. That is, the temperature (=TL) of pure water was set at 40 degrees Celsius. The air temperature (first temperature T1) of the first gas bubble generating device 54 was set at 45 degrees Celsius. The air temperature (second temperature T2) of the second gas bubble generating device 55 was set at 35 degrees Celsius. Apart from the amount of fine gas bubbles (gas bubble density), the above conditions were set. For gas bubble density 1, the amounts of fine gas bubbles of both the first fine gas bubble group 59*a* and the second fine gas bubble group 59*b* were set at on the order of $1\times10^6$ per milliliter as in Condition 3 described above. For gas bubble density 2, the amounts of fine gas bubbles of both the first fine gas bubble group 59*a* and the second fine gas bubble group 59*b* were set at on the order of $5\times10^6$ per milliliter. For gas bubble density 3, the amounts of fine gas bubbles of both the first fine gas bubble group 59*a* and the second fine gas bubble group 59*b* were set at on the order of $1\times10^7$ per milliliter.

Figure 10:
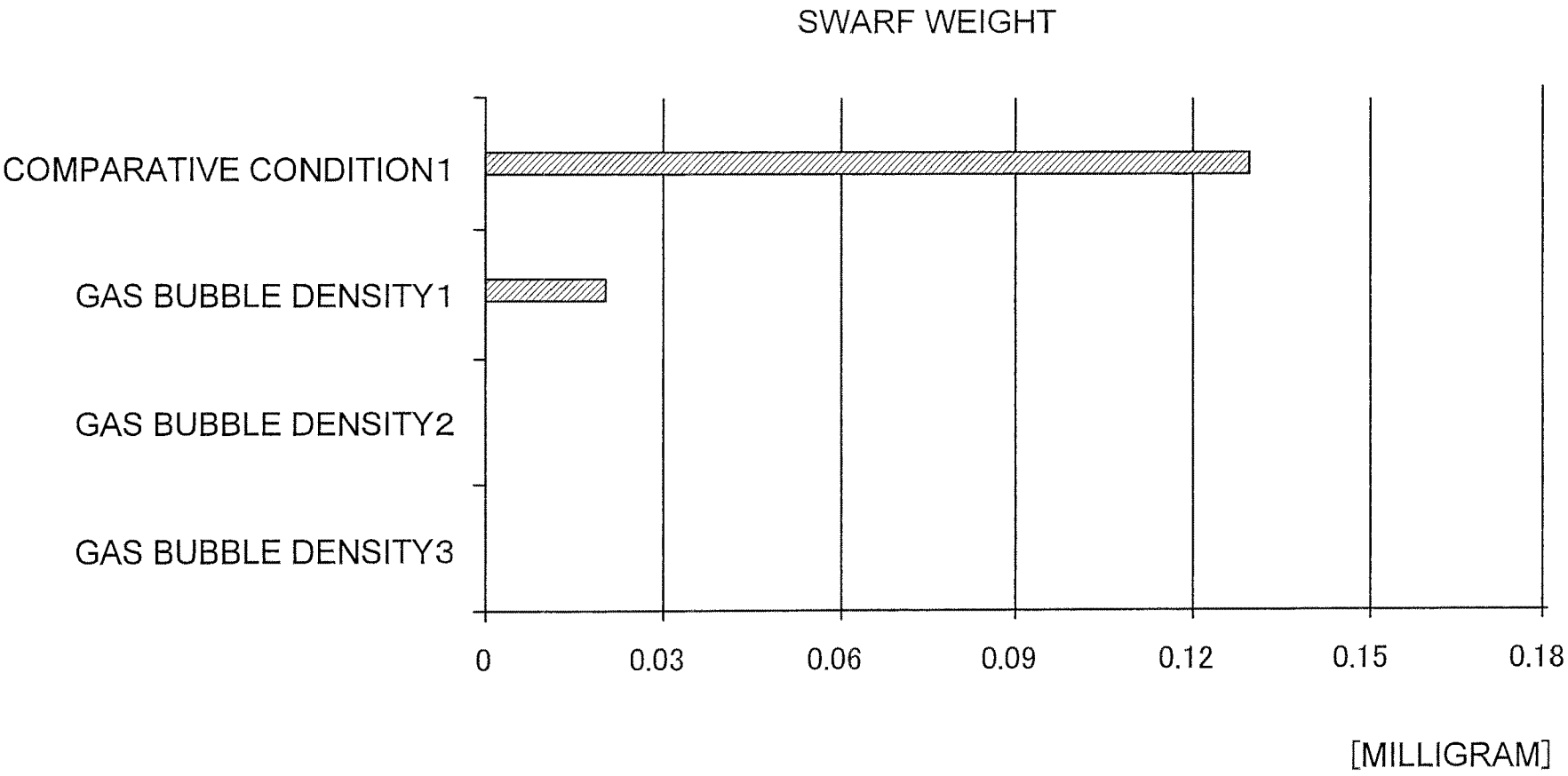
FIG. 10 is a graph showing the relationship between gas bubble density and swarf weight remaining.
Figure 11:
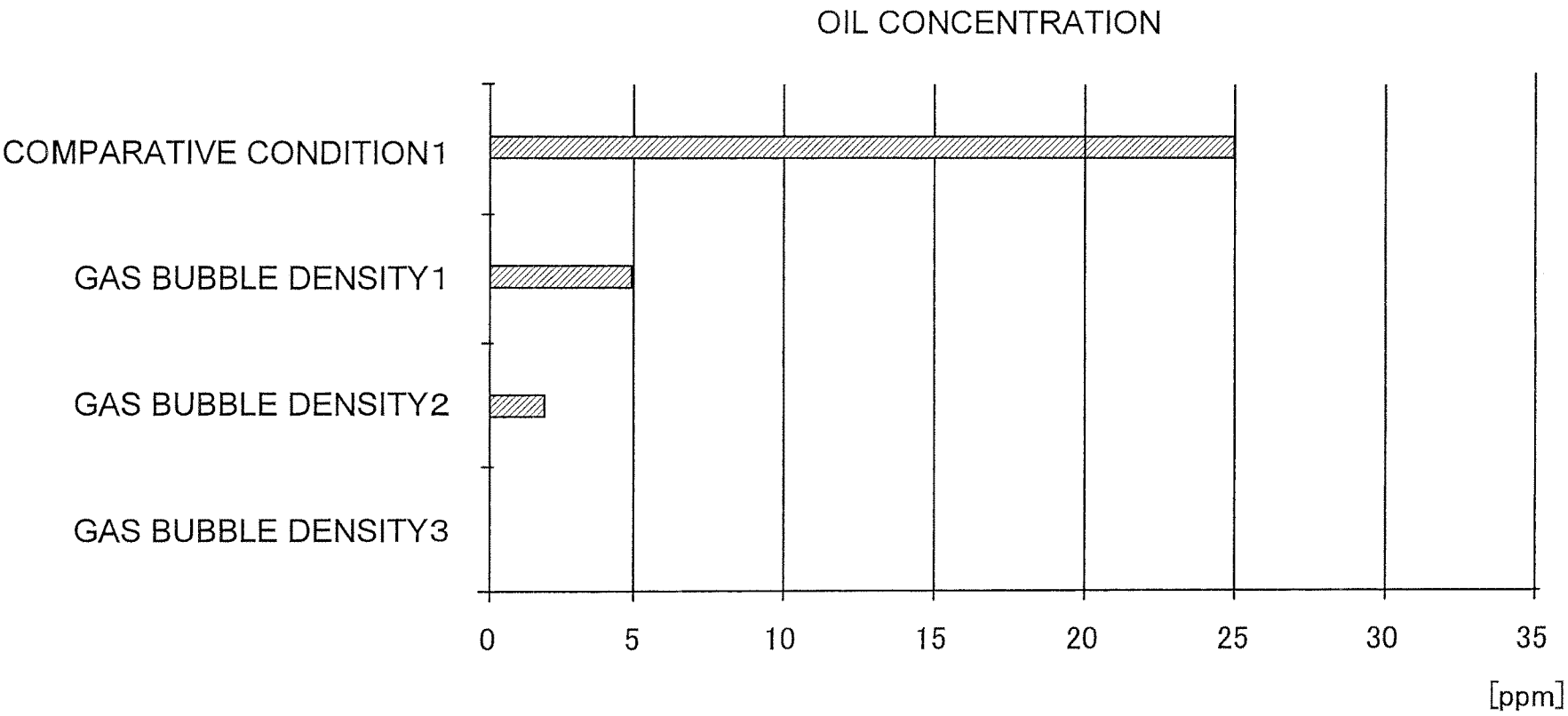
FIG. 11 is a graph showing the relationship between gas bubble density and recovered oil concentration in a solvent.

As shown in FIG. 10, it has been confirmed that the higher the gas bubble density, the higher the cleaning effect for swarf. Similarly, as shown in FIG. 11, it has been confirmed that the higher the gas bubble density, the higher the cleaning effect for oil. In particular, when the gas bubble density was set at $5\times10^6$ or greater per milliliter, only less than 0.01 milligram of swarf remained. It has been confirmed that when the gas bubble density is sufficiently high, most of the swarf is washed away. When the gas bubble density is set at $1\times10^7$ or greater per milliliter, only less than 1 ppm of oil remained. Therefore, it has been confirmed that when the gas bubble density is sufficiently high, most of the oil is washed away.

Subsequently, the present inventors examined the relationship between the cleaning effect and the average diameter (size) of gas bubbles. Similarly to the above, examination was carried out in accordance with the cleaning device 51 related to the fifth embodiment. The temperature conditions of Condition 3 described above were set. That is, the temperature (=TL) of pure water was set at 40 degrees Celsius. The air temperature (first temperature T1) of the first gas bubble generating device 54 was set at 45 degrees Celsius. The air temperature (second temperature T2) of the second gas bubble generating device 55 was set at 35 degrees Celsius. The amount of fine gas bubbles (gas bubble density) was set at on the order of $1\times10^6$ per milliliter similarly to Condition 3. In addition, apart from the diameter of the fine gas bubbles, the above conditions were set. For gas bubble diameter 1 the average diameter of fine gas bubbles of both the first fine gas bubble group 59*a* and the second fine gas bubble group 59*b* was set at on the order of 500 nm similarly to Condition 3 above. For gas bubble diameter 2 the average diameter of fine gas bubbles of both the first fine gas bubble group 59*a* and the second fine gas bubble group 59*b* was set at 200 nm. For gas bubble diameter 3 the average diameter of fine gas bubbles of both the first fine gas bubble group 59*a* and the second fine gas bubble group 59*b* was set at 50 nm. For gas bubble diameter 4 the average diameter of fine gas bubbles of the first fine gas bubble group 59*a* was set at 1000 nm, and the average diameter of fine gas bubbles of the second fine gas bubble group 59*b* was set at 50 nm. That is, high temperature microbubbles and low temperature nanobubbles were used as a combination. For gas bubble diameter 5 the average diameter of fine gas bubbles of the first fine gas bubble group 59*a* was set at 50 nm, and the average diameter of fine gas bubbles of the second fine gas bubble group 59*b* was set at 1000 nm. In other words, low temperature microbubbles and high temperature nanobubbles were used as a combination.

Figure 12:
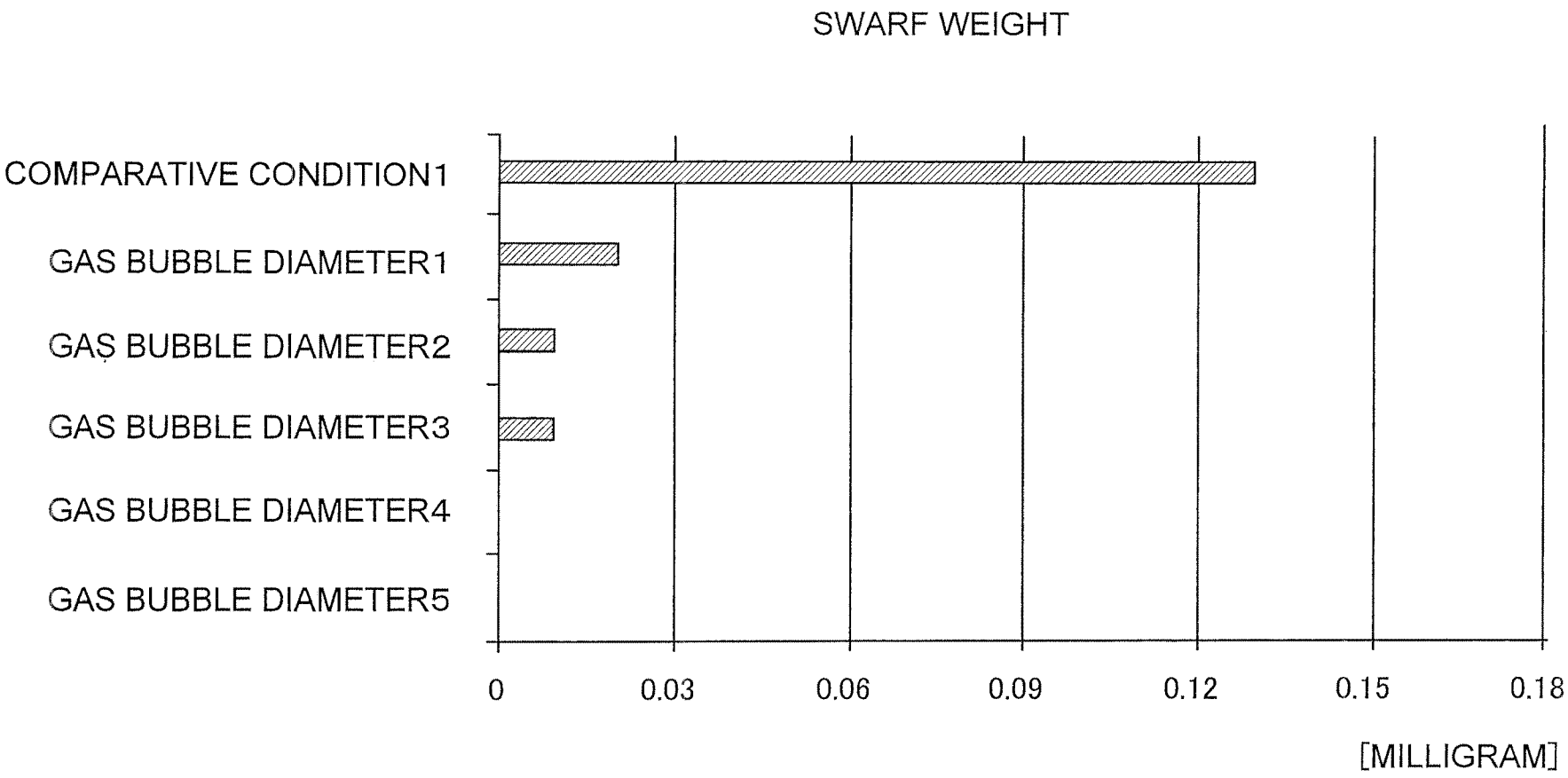
FIG. 12 is a graph showing the relationship between gas bubble average diameter and swarf weight remaining.
Figure 13:
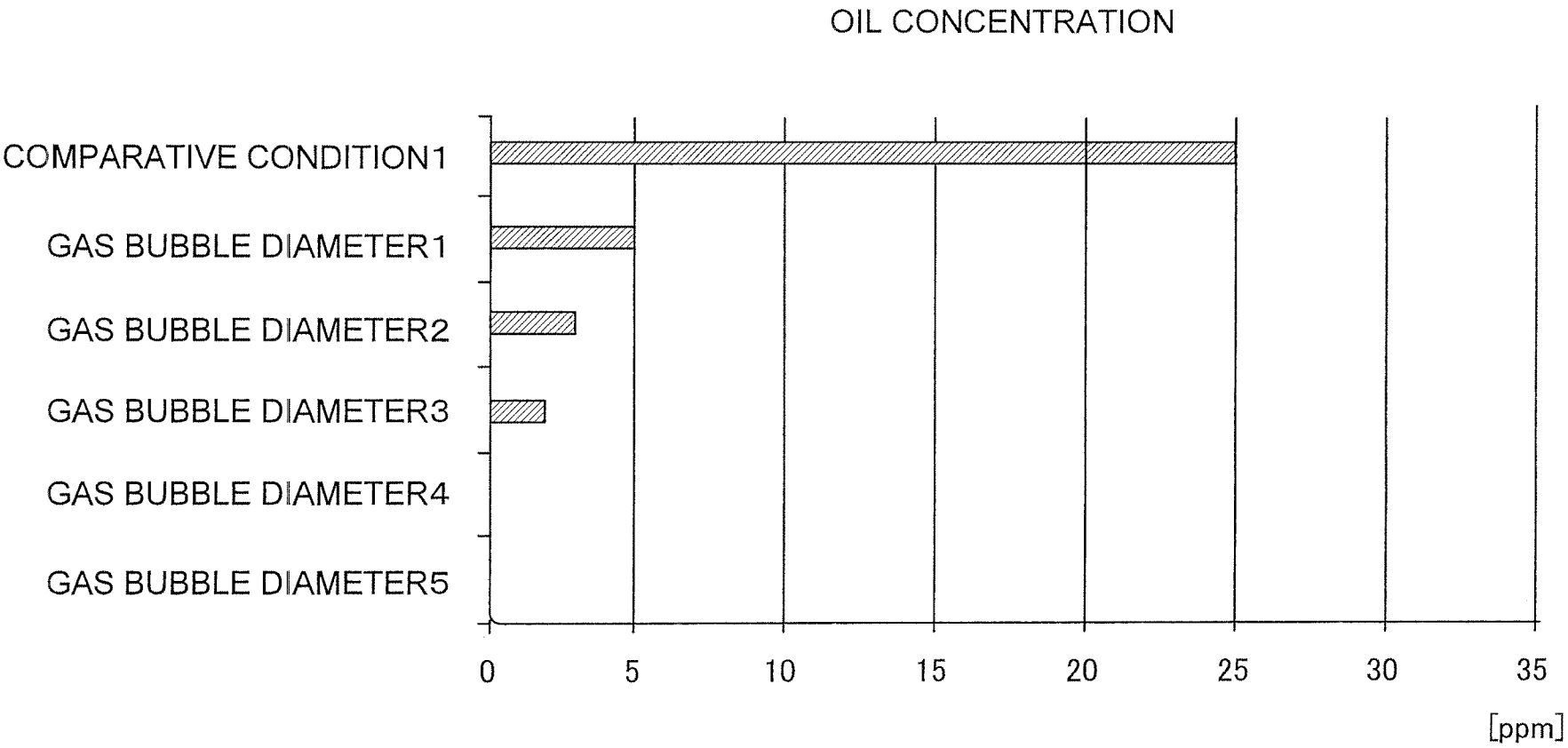
FIG. 13 is a graph showing the relationship between gas bubble average diameter and recovered oil concentration in a solvent.

As shown in FIG. 12, it has been confirmed that for gas bubble diameters 1 to 3 the cleaning effect for swarf is enhanced in response to the gas bubbles becoming smaller. On the other hand, it has been confirmed that as is clear from gas bubble diameters 4 and 5, when the fine gas bubbles of the first fine gas bubble group 59*a* and the fine gas bubbles of the second fine gas bubble group 59*b* have different sizes, in both cases of either thereof being large, the cleaning effect for swarf is greatly enhanced. In particular, it is surmised that a combination of microbubbles and nanobubbles greatly contributes to an increase in the cleaning effect. Similarly, as shown in FIG. 13, it has been confirmed that for gas bubble diameters 1 to 3 the cleaning effect for oil is enhanced in response to the gas bubbles becoming small. On the other hand, it has been confirmed that as is clear from gas bubble diameters 4 and 5, when the fine gas bubbles of the first fine gas bubble group 59*a* and the fine gas bubbles of the second fine gas bubble group 59*b* have different sizes, in both cases of either thereof being large, the cleaning effect for oil is greatly enhanced. In particular, it is surmised that a combination of microbubbles and nanobubbles greatly contributes to an increase in the cleaning effect.

The invention claimed is:

1. A cleaning liquid comprising a liquid, a first fine gas bubble group included in the liquid and comprising a gas at a first temperature, and a second fine gas bubble group included in the liquid and comprising a gas at a second temperature that is lower than the first temperature, wherein the gas bubbles have a diameter of no greater than 1 μm and a concentration of $1\times10^6$ or greater per ml.

2. The cleaning liquid according to claim 1, comprising a liquid including at least one of water and solvent, having at least one of an electrolyte, gas, and surfactant dissolved therein, a first fine gas bubble group included in the liquid and comprising a gas at a first temperature, and a second fine gas bubble group included in the liquid and comprising a gas at a second temperature that is lower than the first temperature, wherein the temperature of the liquid is set at 80° C. or less, and the temperature difference between the first temperature and the second temperature is 10° C. or greater.

* * * * *